US008863524B2

(12) United States Patent
Karlsson et al.

(10) Patent No.: US 8,863,524 B2
(45) Date of Patent: Oct. 21, 2014

(54) BURNER

(75) Inventors: Andreas Karlsson, Norrköping (SE); Vladimir Milosavljevic, Norrköping (SE)

(73) Assignee: Siemens Aktiengesellschaft, Munich (DE)

( * ) Notice: Subject to any disclaimer, the term of this patent is extended or adjusted under 35 U.S.C. 154(b) by 1056 days.

(21) Appl. No.: 12/935,919

(22) PCT Filed: Mar. 26, 2009

(86) PCT No.: PCT/EP2009/053557

§ 371 (c)(1),
(2), (4) Date: Oct. 1, 2010

(87) PCT Pub. No.: WO2009/121777

PCT Pub. Date: Oct. 8, 2009

(65) Prior Publication Data

US 2011/0041508 A1 Feb. 24, 2011

(30) Foreign Application Priority Data

Apr. 1, 2008 (EP) ..... 08006662

(51) Int. Cl.
*F23R 3/14* (2006.01)
*F23R 3/28* (2006.01)
*F23R 3/34* (2006.01)

(52) U.S. Cl.
USPC ..... 60/737; 60/746; 60/748; 60/733; 60/750

(58) Field of Classification Search
CPC ..... F23R 3/286; F23R 3/34; F23R 3/343; F23R 3/346; F23D 2900/00014
USPC ..... 60/737, 748, 746, 749, 750, 732, 733
See application file for complete search history.

(56) References Cited

U.S. PATENT DOCUMENTS

| | | | | |
|---|---|---|---|---|
| 3,872,664 | A * | 3/1975 | Lohmann et al. | 60/746 |
| 4,204,402 | A * | 5/1980 | Craig et al. | 60/746 |
| 4,420,929 | A * | 12/1983 | Jorgensen et al. | 60/737 |
| 4,845,940 | A * | 7/1989 | Beer | 60/748 |
| 5,069,029 | A * | 12/1991 | Kuroda et al. | 60/737 |
| 5,321,948 | A | 6/1994 | Leonard | |
| 5,950,417 | A * | 9/1999 | Robertson et al. | 60/746 |
| 6,438,961 | B2 * | 8/2002 | Tuthill et al. | 60/748 |
| 8,561,409 | B2 * | 10/2013 | Milosavljevic | 60/737 |
| 2002/0043067 | A1 * | 4/2002 | Maeda et al. | 60/747 |
| 2004/0229178 | A1 | 11/2004 | Akizuki | |
| 2005/0106520 | A1 * | 5/2005 | Cornwell et al. | 431/116 |
| 2007/0175219 | A1 * | 8/2007 | Cornwell et al. | 60/737 |

FOREIGN PATENT DOCUMENTS

| | | | |
|---|---|---|---|
| GB | 812317 | A | 4/1959 |
| JP | 09264536 | A | 10/1997 |
| WO | WO 2005/040682 | A2 | 5/2005 |

* cited by examiner

*Primary Examiner* — Ted Kim

(57) ABSTRACT

A burner for a gas turbine including a burner housing is provided. Provided is a lean-rich partially premixed low emission burner for a gas turbine combustor providing stable ignition and combustion process at all engine load conditions. At the upstream end of that burner a pilot combustor creates a flow of an unquenched concentration of radicals and heat. Respectively provided is a plurality of quarl sections surrounding the exit of the pilot combustor, a main combustion room defined downstream the pilot combustor and at least a first channel defined as an annular space between an upstream quarl section and the closest downstream quarl section providing air and fuel to a main flame in the combustion room.

19 Claims, 7 Drawing Sheets

BURNER

CROSS REFERENCE TO RELATED APPLICATIONS

This application is the US National Stage of International Application No. PCT/EP2009/053557, filed Mar. 26, 2009 and claims the benefit thereof. The International Application claims the benefits of European Patent Office application No. 08006662.4 EP filed Apr. 1, 2008. All of the applications are incorporated by reference herein in their entirety.

TECHNICAL FIELD

The present invention refers to a burner preferably for use in gas turbine engines, and more particularly to a burner adapted to stabilize engine lean partially premixed (LPP) combustion process and engine turndown requirements, and further to a burner that use a pilot combustor to provide combustion products (radicals and heat) to stabilize a main lean partially premixed combustion process.

TECHNICAL BACKGROUND

U.S. Pat. No. 5,321,984 A discloses a fuel staged premixed dry low $NO_x$ combustor comprising at lest to concentric cylinders in a staggered arrangement, between which a channel is foliated to provide a mixture of fuel and air into a combustion zone. The combustion is initiated by a spark igniter. After ignition the combustion is supposed to maintain itself by burning the fuel air mixture supplied from the concentric staggered annual channels. Since no further measures were taken to avoid a blow out of the combustion, this combustor can not be operated with a very lean fuel-air-mixture in order to maintain a stable operation. Patent application US 2004/0229178 A1 deals with a premixing nozzle to be used in a combustor for a supply of a fuel air mixture. Patent specification GB 812 317 deals with a ram jet, which is especially useful for super sonic airplanes comprising concentric cylinders equipped with fuel burners to promote airflow through the jet for additional thrust. The Japanese patent application JP 09-264536 deals with the fuel supply by a special device, which is useful for liquid and gaseous fuel selectively.

Gas turbine engines are employed in a variety of applications including electric power generation, military and commercial aviation, pipeline transmission and marine transportation. In a gas turbine engine which operates in LPP mode, fuel and air are provided to a burner chamber where they are mixed and ignited by a flame, thereby initiating combustion. The major problems associated with the combustion process in gas turbine engines, in addition to thermal efficiency and proper mixing of the fuel and the air, are associated to flame stabilization, the elimination of pulsations and noise, and the control of polluting emissions, especially nitrogen oxides (NOx), CO, UHC, smoke and particulated emission.

In industrial gas turbine engines, which operate in LPP mode, flame temperature is reduced by an addition of more air than required for the combustion process itself. The excess air that is not reacted must be heated during combustion, and as a result flame temperature of the combustion process is reduced (below stoichiometric point) from approximately 2300K to 1800 K and below. This reduction in flame temperature is required in order to significantly reduce NOx emissions. A method shown to be most successful in reducing NOx emissions is to make combustion process so lean that the temperature of the flame is reduced below the temperature at which diatomic Nitrogen and Oxygen (N2 and O2) dissociate and recombine into NO and NO2. Swirl stabilized combustion flows are commonly used in industrial gas turbine engines to stabilize combustion by, as indicated above, developing reverse flow (Swirl Induced Recirculation Zone) about the centreline, whereby the reverse flow returns heat and free radicals back to the incoming un-burnt fuel and air mixture. The heat and free radicals from the previously reacted fuel and air are required to initiate (pyrolyze fuel and initiate chain branching process) and sustain stable combustion of the fresh un-reacted fuel and air mixture. Stable combustion in gas turbine engines requires a cyclic process of combustion producing combustion products that are transported back upstream to initiate the combustion process. A flame front is stabilised in a Shear-Layer of the Swirl Induced Recirculation Zone. Within the Shear-Layer "Local Turbulent Flame Speed of the Air/Fuel Mixture" has to be higher then "Local Air/Fuel Mixture Velocity" and as a result the Flame Front/combustion process can be stabilised.

Lean premixed combustion is inherently less stable than diffusion flame combustion for the following reasons:

The amount of air required to reduce the flame temperature from 2300K to 1700-1800 K is approximately twice the amount of air required for stoichiometric combustion. This makes the overall fuel/air ratio (□) very close (around or below 0.5; □>0.5) or similar to a fuel/air ratio at which lean extinction of the premixed flame occurs. Under these conditions the flame can locally extinguish and re-light in a periodic manner.

Near the lean extinction limit the flame speed of the lean partially premixed flames is very sensitive to the equivalence ratio fluctuations. Fluctuations in flame speed can result in spatial fluctuations/movements of the flame front (Swirl Induced Recirculation Zone). A less stable, easy to move flame front of a pre-mixed flame results in a periodic heat release rate, that, in turn, results in movement of the flame, unsteady fluid dynamic processes, and thermo-acoustic instabilities develop.

Equivalence ratio fluctuations are probably the most common coupling mechanism to link unsteady heat release to unsteady pressure oscillations.

In order to make the combustion sufficiently lean, in order to be able to significantly reduce NOx emissions, nearly all of the air used in the engine must go through the injector and has to be premixed with fuel. Therefore, all the flow in the burners has the potential to be reactive and requires that the point where combustion is initiated is fixed.

When the heat required for reactions to occur is the stability-limiting factor, very small temporal fluctuations in fuel/air equivalence ratios (which could either result either from fluctuation of fuel or air flow through the Burner/Injector) can cause flame to partially extinguish and re-light.

An additional and very important reason for the decrease in stability in the pre-mixed flame is that the steep gradient of fuel and air mixing is eliminated from the combustion process. This makes the premixed flow combustible anywhere where there is a sufficient temperature for reaction to occur. When the flame can, more easily, occur in multiple positions, it becomes more unstable. The only means for stabilizing a premixed flame to a fixed position are based on the temperature gradient produced where the unburnt premixed fuel and air mix with the hot products of combustion (flame cannot occur where the temperature is too low). This leaves the thermal gradient produced by the generation, radiation, diffusion and convection of heat as a method to stabilize the premixed flame. Radiation heating of the fluid does not produce a sharp gradient; therefore, stability must come from the generation, diffusion and convection of heat into the pre-reacted zone. Diffusion only produces a sharp gradient in laminar flow and not turbulent flows, leaving only convection and energy generation to produce the sharp gradients desired for flame stabilization which is actually heat and free radial gradients. Both, heat and free radial gradients, are generated, diffused and convected by the same mechanisms through recirculating products of combustion within the Swirl Induced Recirculation Zone.

In pre-mixed flows, as well as diffusion flows, rapid expansion causing separations and swirling recirculating flows, are both commonly used to produce gradients of heat and free radicals into the pre-reacted fuel and air.

Document WO 2005/040682 A2 describes a solution directed to a burner for gas turbine engines that use a pilot flame to assist in sustaining and stabilizing the combustion process.

SUMMARY OF THE INVENTION

Disclosed is a lean-rich partially premixed low emissions burner for a gas turbine combustor that provides stable ignition and combustion process at all engine load conditions. This burner operates according to the principle of "supplying" heat and high concentration of free radicals from a pilot combustor exhaust to a main flame burning in a lean premixed air/fuel swirl, whereby a rapid and stable combustion of the main lean premixed flame is supported. The pilot combustor supplies heat and supplements a high concentration of free radicals directly to a forward stagnation point and a shear layer of the main swirl induced recirculation zone, where the main lean premixed flow is mixed with hot gases products of combustion provided by the pilot combustor. This allows a leaner mix and lower temperatures of the main premixed air/fuel swirl combustion that otherwise would not be self-sustaining in swirl stabilized recirculating flows during the operating conditions of the burner.

According to a first aspect of the invention there is herein presented a burner characterized by the features of the claims.

According to a second aspect of the invention there is presented a method for burning a fuel as characterized in the independent method claim.

Further aspects of the invention are presented in the dependent claims.

The burner utilizes:

A swirl of air/fuel above swirl number ($S_N$) 0.7 (that is above critical $S_N$=0.6), generated-imparted into the flow, by a radial swirler;

active species—non-equilibrium free radicals being released close to the forward stagnation point, particular type of the burner geometry with a multi quarl device, and internal staging of fuel and air within the burner to stabilize combustion process at all gas turbine operating conditions.

In short, the disclosed burner provides stable ignition and combustion process at all engine load conditions. Some important features related to the inventive burner are:

the geometric location of the burner elements;

the amount of fuel and air staged within the burner;

the minimum amount of active species—radicals generated and required at different engine/burner operating conditions;

fuel profile;

mixing of fuel and air at different engine operating conditions;

imparted level of swirl;

multi (minimum double quarl) quarl arrangement.

To achieve as low as possible emission levels, a target in this design/invention is to have uniform mixing profiles at the exit of lean premixing channels. Two distinct combustion zones exist within the burner covered by this disclosure, where fuel is burnt simultaneously at all times. Both combustion zones are swirl stabilized and fuel and air are premixed prior to the combustion process. A main combustion process, during which more than 90% of fuel is burned, is lean. A supporting combustion process, which occurs within the small pilot combustor, wherein up to 1% of the total fuel flow is consumed, could be lean, stoichiometric and rich (equivalence ratio, ($\Phi$=1.4 and higher).

An important difference between the disclosed burner and a burner as presented in the prior art document is that a bluff body is not needed in the pilot combustor as the present invention uses un un-quenched flow of radicals directed downstream from a combustion zone of the pilot combustor along a centre line of the pilot combustor, said flow of radicals being released through the full opening area of a throat of the pilot combustor at an exit of the pilot combustor.

The main reason why the supporting combustion process in the small pilot combustor could be lean, stoichiometric or rich and still provide stable ignition and combustion process at all engine load conditions is related to combustion efficiency. The combustion process, which occurs within the small combustor-pilot, has low efficiency due to the high surface area which results in flame quenching on the walls of the pilot combustor. Inefficient combustion process, either being lean, stoichiometric or rich, could generate a large pool of active species—radicals which is necessary to enhance stability of the main lean flame and is beneficial for a successful operation of the present burner design/invention (Note: the flame occurring in the premixed lean air/fuel mixture is herein called the lean flame).

It would be very difficult to sustain (but not to ignite, because the small pilot combustor can act as a torch igniter) combustion in the shear layer of the main recirculation zone below LBO (Lean Blow Off) limits of the main lean flame (approx. T >1350 K and $\Phi \geq 0.25$). For engine operation below LBO limits of the main lean flame, in this burner design, additional "staging" of the small combustor-pilot is used/provided. The air which is used to cool the small pilot combustor internal walls (performed by a combination of impingement and convecting cooling) and which represents approximately 5-8% of the total air flow through the burner, is premixed with fuel prior the swirler. Relatively large amount of fuel can be added to the small pilot combustor cooling air which corresponds to very rich equivalence ratios ($\Phi$>3). Swirled cooling air and fuel and hot products of combustion from the small pilot combustor, can very effectively sustain combustion of the main lean flame below, at and above LBO limits. The combustion process is very stable and efficient because hot combustion products and very hot cooling air (above 750° C.), premixed with fuel, provide heat and active species (radicals) to the forward stagnation point of the main flame recirculation zone. During this combustion process the small pilot combustor, combined with very hot cooling air (above 750° C.) premixed with fuel act as a flameless burner, where reactants (oxygen & fuel) are premixed with products of combustion and a distributed flame is established at the forward stagnation point of the swirl induced recirculation zone.

To enable a proper function and stable operation of the burner disclosed in the present application, it is required that the imparted level of swirl and the swirl number (equation 1) is above the critical one (not lower then 0.6 and not higher then 0.8) at which vortex breakdown—recirculation zone will form and will be firmly positioned within the multi quarl arrangement. The forward stagnation point P should be located within the quarl and at the exit of the pilot combustor. The main reasons, for this requirement, are:

If the imparted level of swirl is low and the resulting swirl number is below 0.6, for most burner geometries, a weak, recirculation zone will form and unstable combustion can occur.

A strong recirculation zone is required to enable transport of heat and free radicals from the previously combusted fuel and air, back upstream towards the flame front. A well established and a strong recirculation zone is required to provide a shear layer region where turbulent flame speed can "match" or be proportional to the local fuel/air mixture, and a stable flame can establish. This flame front established in the shear layer of the main recirculation zone has to be steady and no periodic movements or procession of the flame front should occur. The imparted swirl number can be high, but should not be higher then 0.8, because at and above this swirl number more then 80% of the total amount of the flow will be recirculated back. A further increase in swirl number will not contribute more to the increase in the amount of the recirculated mass of the combustion products, and the flame in the shear layer of the recirculation zone will be subjected to high turbulence and strain which can result in quenching and partial extinction and reignition of the flame. Any type of the swirl generator, radial, axial and axial-radial can be used in the burner, covered by this disclosure. In this disclosure a radial swirler configuration is shown.

The burner utilizes aerodynamics stabilization of the flame and confines the flame stabilization zone—the recirculation zone—in the multiple quarl arrangement. The multiple quarl arrangement is an important feature of the design of the provided burner for the following reasons. The quarl (or also called diffuser):

- provides a flame front (main recirculation zone) anchoring the flame in a defined position in space, without a need to anchore the flame to a solid surface/bluff body, and in that way a high thermal loading and issues related to the burner mechanical integrity are avoided;
- geometry (quarl half angle $\alpha$ and length L) is important to control size and shape of the recirculation zone in conjunction with the swirl number. The length of the recirculation zone is roughly proportional to 2 to 2.5 of the quarl length;
- optimal length L is of the order of L/D=1 (D is the quarl throat diameter). The minimum length of the quarl should not be smaller then L/D=0.5 and not longer then L/D=2;
- optimal quarl half angle $\alpha$ should not be smaller then 20 and larger then 25 degrees,
- allows for a lower swirl before decrease in stability, when compared to a less confined flame front; and
- has the important task to control the size and shape of the recirculation zone as the expansion of the hot gases as a result of combustion reduces transport time of free radicals in the recirculation zone.

EMBODIMENTS OF THE INVENTION

In the following a number of embodiments will be described in more detail with references to the enclosed drawings.

Figure 1:
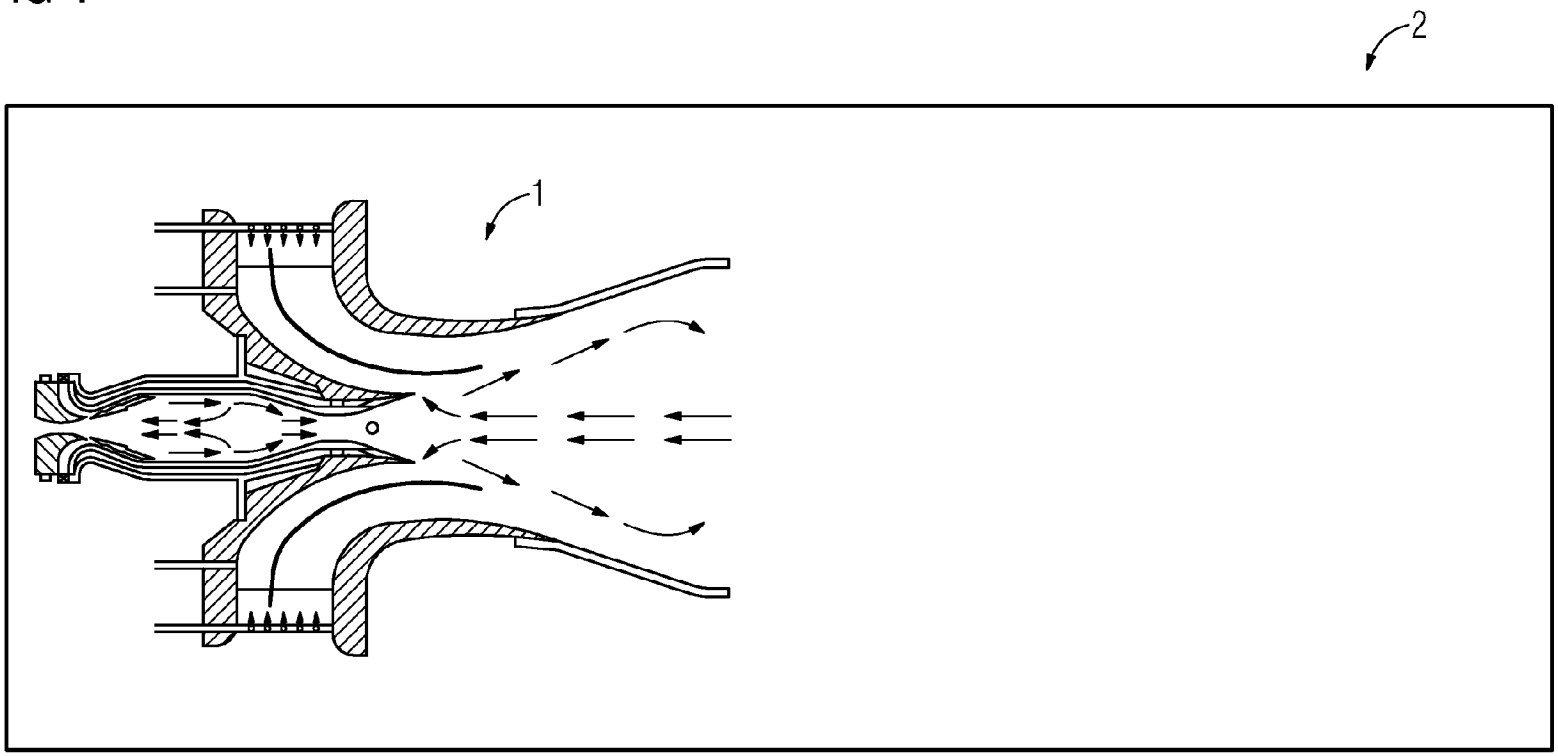
FIG. 1 is a simplified cross section schematically showing the burner according to the aspects of the invention enclosed in a housing without any details showing how the burner is configured inside said housing.

In FIG. 1 the burner is depicted with the burner 1 having a housing 2 enclosing the burner components.

Figure 2A:
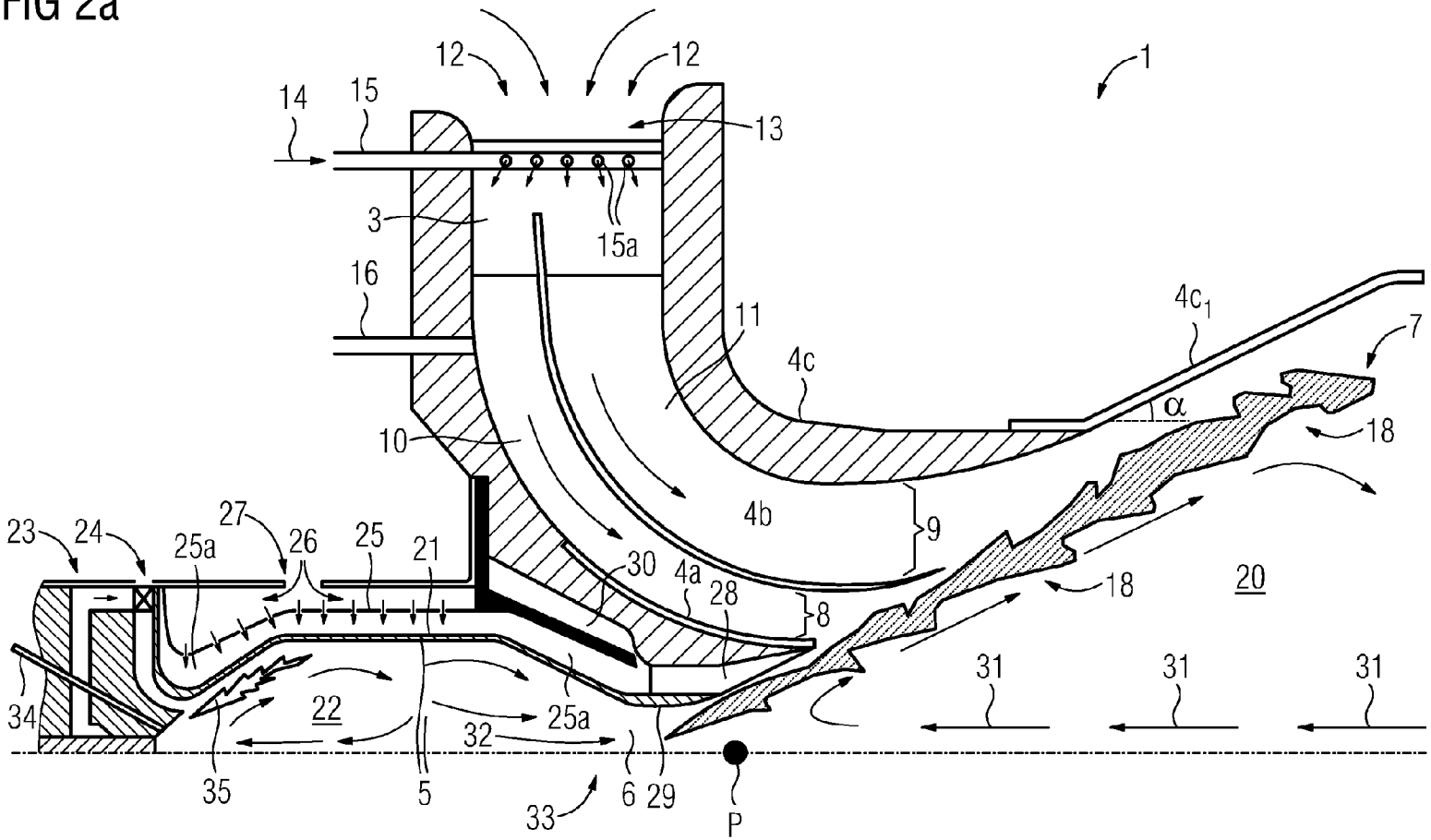
FIG. 2*a* is a cross section through the burner schematically showing a section above a symmetry axis, whereby a rotation around the symmetry axis forms a rotational body displaying a layout of the burner.

FIG. 2*a* shows for the sake of clarity a cross sectional view of the burner above a rotational symmetry axis. The main parts of the burner are the radial swirler 3, the multi quarl 4*a*, 4*b*, 4*c* and the pilot combustor 5.

As stated, the burner 1 operates according to the principle of "supplying" heat and high concentration of free radicals from the a pilot combustor 5 exhaust 6 to a main flame 7 burning in a lean premixed air/fuel swirl emerging from a first exit 8 of a first lean premixing channel 10 and from a second exit 9 of a second lean premixing channel 11, whereby a rapid and stable combustion of the main lean premixed flame 7 is supported. Said first lean premixing channel 10 is formed by and between the walls 4*a* and 4*b* of the multi quarl. The second lean premixing channel 11 is formed by and between the walls 4*b* and 4*c* of the multi quarl. The outermost rotational symmetric wall 4*c* of the multi quarl is provided with an extension 4*c*1 to provide for the optimal length of the multi quarl arrangement. The first 10 and second 11 lean premixing channels are provided with swirler wings fanning the swirler 3 to impart rotation to the air/fuel mixture passing through the channels.

Air 12 is provided to the first 10 and second 11 channels at the inlet 13 of said first and second channels. According to the embodiment shown the swirler 3 is located close to the inlet 13 of the first and second channels. Further, fuel 14 is introduced to the air/fuel swirl through a tube 15 provided with small diffusor holes 15*a* located at the air 12 inlet 13 between the swirler 3 wings, whereby the fuel is distributed into the air flow through said holes as a spray and effectively mixed with the air flow. Additional fuel can be added through a second tube 16 emerging into the first channel 10.

When the lean premixed air/fuel flow is burnt the main flame 7 is generated. The flame 7 is formed as a conical rotational symmetric shear layer 18 around a main recirculation zone 20 (below sometimes abbreviated RZ). The flame 7 is enclosed inside the extension 4*c*1 of the outermost quarl, in this example quarl 4*c*.

The pilot combustor 5 supplies heat and supplements a high concentration of free radicals directly to a forward stagnation point P and the shear layer 18 of the main swirl induced recirculation zone 20, where the main lean premixed flow is mixed with hot gases products of combustion provided by the pilot combustor 5.

The pilot combustor 5 is provided with walls 21 enclosing a combustion room for a pilot combustion zone 22. Air is supplied to the combustion room through fuel channel 23 and air channel 24. Around the walls 21 of the pilot combustor 5 there is a distributor plate 25 provided with holes over the surface of the plate. Said distributor plate 25 is separated a certain distance from said walls 21 forming a cooling space layer 25*a*. Cooling air 26 is taken in through a cooling inlet 27 and meets the outside of said distributor plate 25, whereupon the cooling air 26 is distributed across the walls 21 of the pilot combustor to effectively cool said walls 21. The cooling air 26, now heated to up to 1000 K, is after said cooling let out through a second swirler 28 arranged around a pilot quarl 29 of the pilot combustor 5. Further fuel can be added to the combustion in the main lean flame 7 by supplying fuel in a duct 30 arranged around and outside the cooling space layer 25*a*. Said further fuel is then let out and into the second swirler 28, where the now hot cooling air 26 and the fuel added through duct 30 is effectively premixed (FIG. 2*a*). According to this embodiment (a) the heated cooling air (26) is supplied to the main flame (7) at the most upstream end of the main flame (5) close to the forward stagnation point P.

Figure 2B:
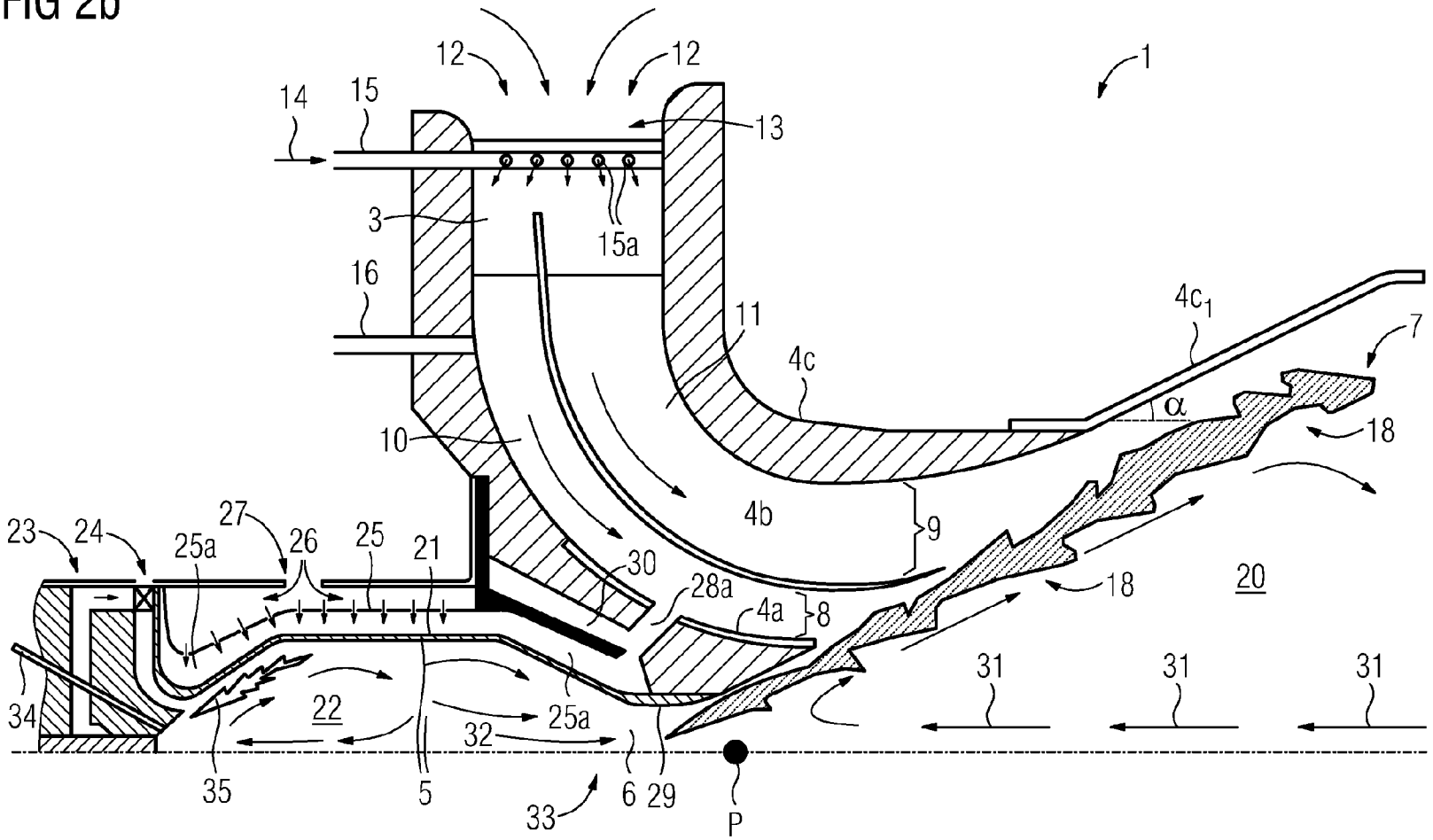
FIG. 2*b* is a cross section through the burner according to FIG. 2*a*, with the difference that air cooling the pilot combustor is let out to an air/fuel premix channel serving the main flame with air and fuel.
Figure 2C:
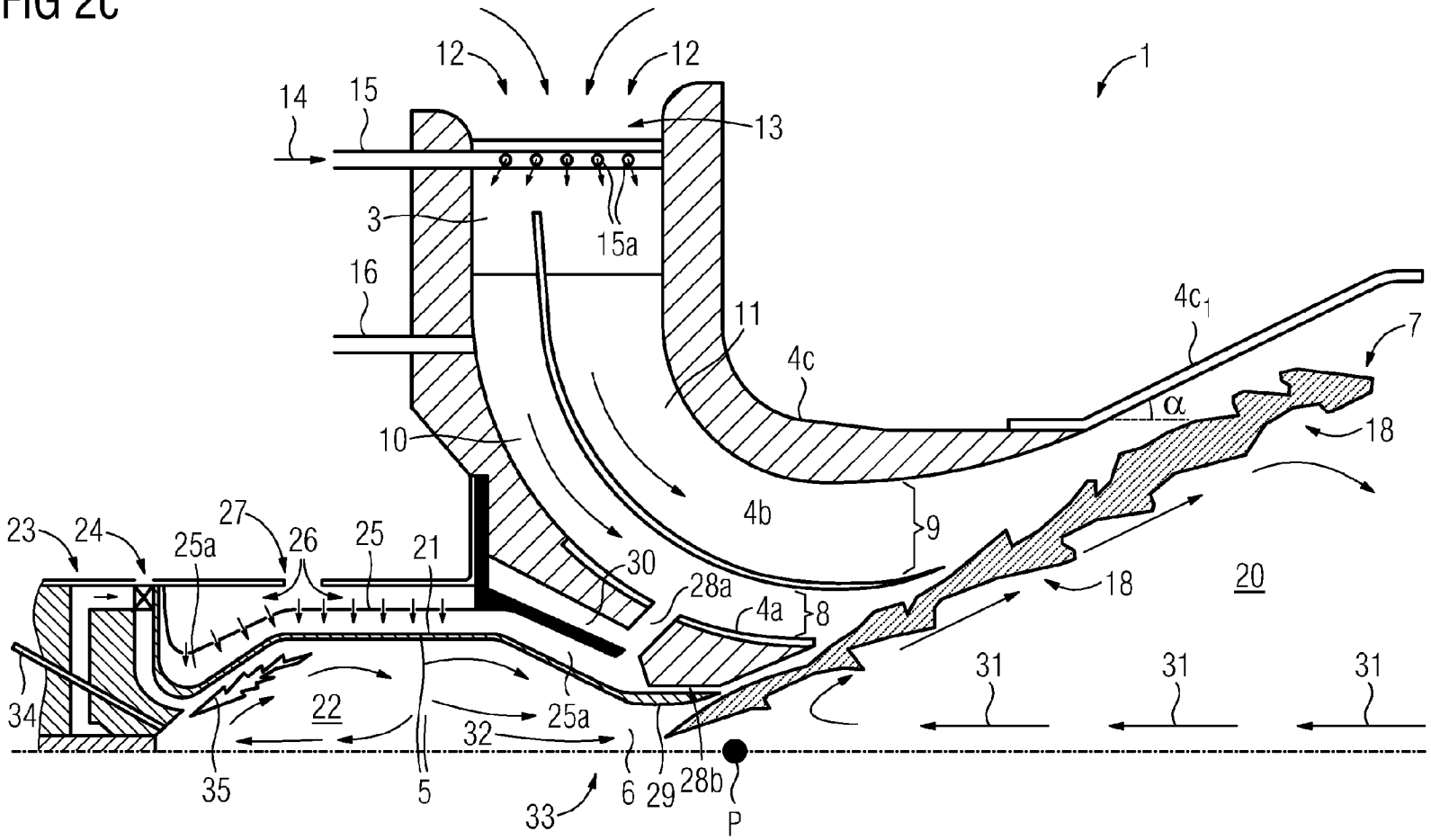
FIG. 2*c* is a cross section of the burner of FIG. 2*a*, wherein the air cooling the pilot combustor is let out according to a mix of the disclosures of FIG. 2*a* and FIG. 2*b*.

In alternative embodiments (see FIGS. 2*b* and 2*c*) said cooling air 26 is in a heated state supplied to said main flame 7 as one of:

b) the heated cooling air 26 is let out into said first channel 10 through an opening 28*a*, thus introduced to said main flame 7 from a channel 10 running through the quarl 4*a*, 4*b*, 4*c* defining a combustion room housing said combustion process (FIG. 2*b*).

c) the cooling air is provided to said main lean partially premixed combustion process as a mix of a) and b) as the heated cooling air is let out to the first channel through said opening 28*a* and also through a small annular channel 28*b* around the quarl of the pilot combustor 5.

In embodiment b) the heated cooling air is provided close to the inside of the walls of first channel 10 and introduced into the main flame further downstream when compared to embodiment a). In embodiment c) a major part of the heated cooling air 26 is let out to the first channel 20 through opening 28*a* and a minor part is let out to the main flame 7 through said small annular channel 28*b*. Said minor part could be less than 10% of the heated cooling 26 air and preferably around 1% of the heated cooling air 26

A relatively large amount of fuel can be added to the small pilot combustor 5 cooling air which corresponds to very rich equivalence ratios (Φ>3). Swirled cooling air and fuel and hot products of combustion from the small pilot combustor, can very effectively sustain combustion of the main lean flame 7 below, at and above LBO limits. The combustion process is very stable and efficient because hot combustion products and very hot cooling air (above 750° C.), premixed with fuel, provide heat and active species (radicals) to the forward stagnation point P of the main flame recirculation zone 20. During this combustion process the small pilot combustor 5, combined with very hot cooling air (above 750° C.) premixed with fuel act as a flameless burner, where reactants (oxygen & fuel) are premixed with products of combustion and a distributed flame is established at the forward stagnation point P of the swirl induced recirculation zone 20.

Figure 3:
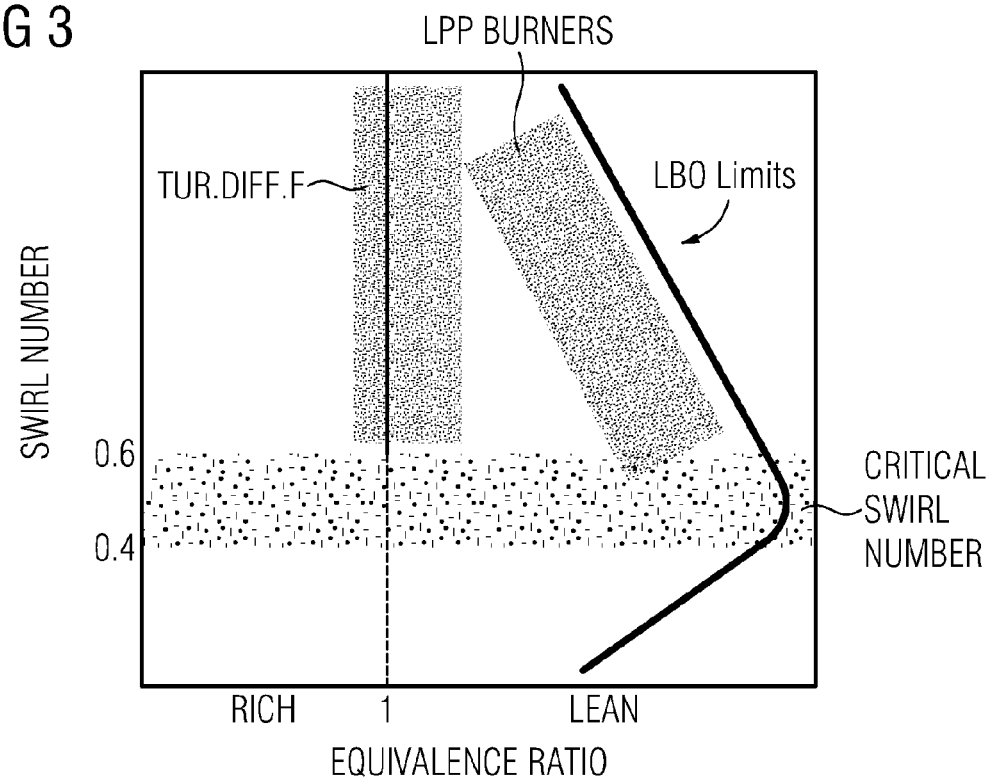
FIG. 3 shows a diagram of stability limits of the flame as a function of the swirl number, imparted level of swirl and equivalence ratio.
Figure 4A:
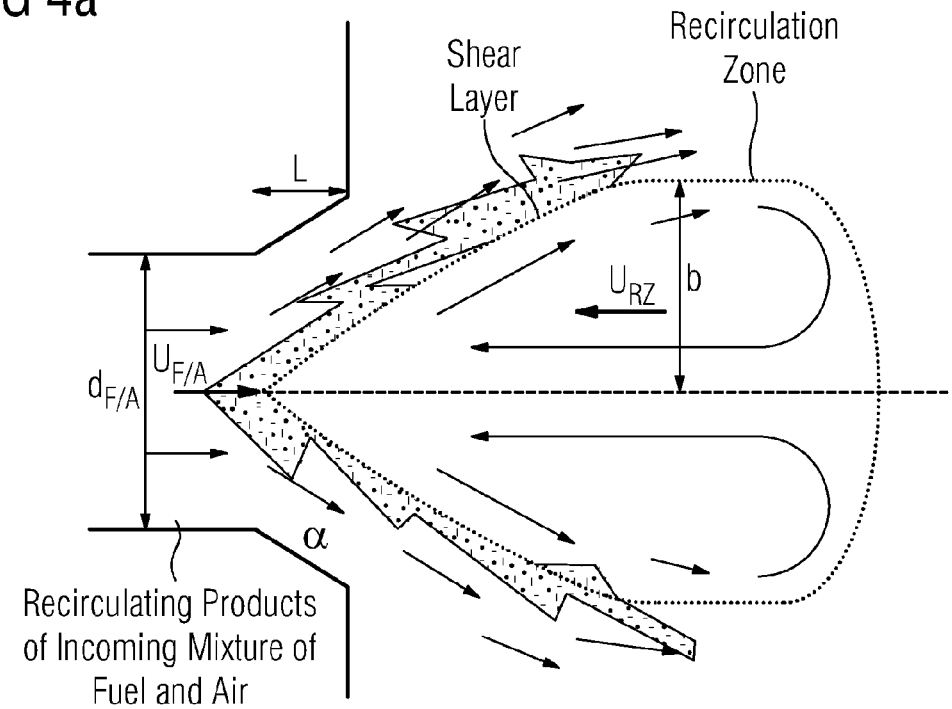
FIG. 4*a*: shows a diagram of combustor near field aerodynamics.

To enable a proper function and stable operation of the burner 1 disclosed in the present application, it is required that the imparted level of swirl and the swirl number (equation 1) is above the critical one (not lower then 0.6 and not higher then 0.8, see also FIG. 3) at which vortex breakdown—recirculation zone 20—will form and will be firmly positioned within the multi quarl 4*a*, 4*b*, 4*c* arrangement. The forward stagnation point P should be located within the quarl 4*a*, 4*b*, 4*c* and at the exit 6 of the pilot combustor 5. Some main reasons, for this requirement, were mentioned in the summary above. A further reason is:

If the swirl number is larger than 0.8, the swirling flow will extend to the exit of the combustor, which can result in an overheating of subsequent guide vanes of a turbine.

$$S_N = \frac{\int \rho U W r^2 dr}{R_2 \int (\rho U^2 + p) r dr} \tag{1}$$

Where r is the radial coordinate direction, the limits of the integrals are the inner and outer radii of an annular tube carrying the air, $R_1$ and $R_2$, respectively. U, and W are the axial and radial swirl components and p is the local static pressure. Below is presented a summary of the imparted level of swirl and swirl number requirements. See also FIGS. 4*a* and 4*b*.

The imparted level of swirl (the ratio between tangential and axial momentum) has to be higher then the critical one (0.4-0.6), so that a stable central recirculation zone 20 can form. The critical swirl number, $S_N$, is also a function of the burner geometry, which is the reason for why it varies between 0.4 and 0.6. If the imparted swirl number is ≤0.4 or in the range of 0.4 to 0.6, the main recirculation zone 20, may not form at all or may form and extinguish periodically at low frequencies (below 150 Hz) and the resulting aerodynamics could be very unstable which will result in a transient combustion process.

In the shear layer 18 of the stable and steady recirculation zone 20, with strong velocity gradient and turbulence levels, flame stabilization can occur if:

turbulent flame speed (ST)>local velocity of the fuel air mixture (UF/A).

Recirculating products which are: source of heat and active species (symbolized by means of arrows 1*a* and 1*b*), located within the recirculation zone 20, have to be stationary in space and time downstream from the mixing section of the burner 1 to enable pyrolysis of the incoming mixture of fuel and air. If a steady combustion process is not prevailing, thermo-acoustics instabilities will occur.

Swirl stabilized flames are up to five times shorter and have significantly leaner blow-off limits then jet flames.

A premixed or turbulent diffusion combustion swirl provides an effective way of premixing fuel and air.

The entrainiment of the fuel/air mixture into the shear layer of the recirculation zone 20 is proportional to the strength of the recirculation zone, the swirl number and the characteristics recirculation zone velocity URZ.

The characteristics recirculation zone velocity, URZ, can be expressed as:

$$URZ=UF/A\ f(MR, dF/A, cent/dF/A, S_N),$$

wherein:

$$MR=r\text{cent}(UF/A,\text{cent})2/rF/A(UF/A)2$$

Experiments (Driscoll 1990, Whitelaw 1991) have shown that $$RZ\ \text{strength}=(MR)\exp-\tfrac{1}{2}(dF/A/dF/A,cent)(URZ/UF/A)(b/dF/A),$$

and

MR should be <1.

(dF/A/dF/A,cent), only important for turbulent diffusion flames.

recirculation zones size/length is "fixed" and proportional to 2-2.5 dF/A.

Not more than approximately 80% of the mass recirculates back above $S_N$=0.8 independently of how high $S_N$ is further increased Addition of Quarl-diverging walls downstream of the throat of the burner-enhances recirculation (Batchelor 67, Hallet 87, Lauckel 70, Whitelow 90); and Lauckel 70 has found that optimal geometrical parameters were: $\alpha$=20°-25°; L/dF/A,min=1 and higher.

This suggests that dquarl/dF/A=2-3, but stability of the flame suggests that leaner lean blow-off limits were achieved for values close to 2 (Whitelaw 90).

Experiments and practical experience suggest also that UF/A should be above 30-50 m/s for premixed flames due to risks of flashback (Proctor 85).

If a backfacing step is placed at the quarl exit, then external RZ if formed. The length of the external RZ, LERZ is usually ⅔ hERZ.

Active Species—Radicals

Figure 6:
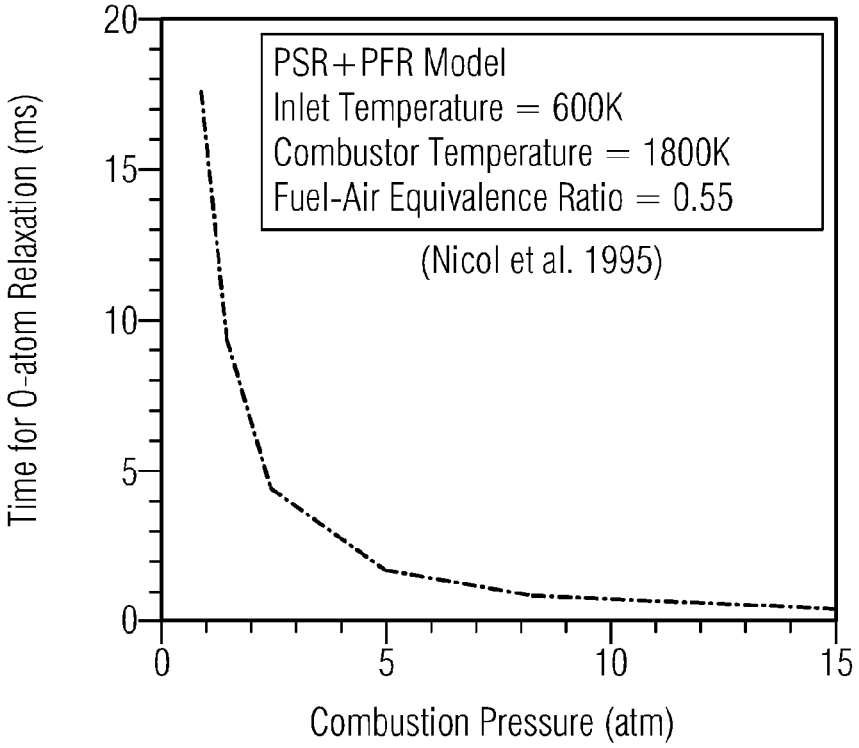
FIG. 6 shows a diagram of relaxation time as a function of combustion pressure.

In the swirl stabilized combustion, the process is initiated and stabilized by means of transporting heat and free radicals 31 from the previously combusted fuel and air, back upstream towards the flame front 7. If the combustion process is very lean, as is the case in lean-partially premixed combustion systems, and as a result the combustion temperature is low, the equilibrium levels of free radicals is also very low. Also, at high engine pressures the free radicals produced by the combustion process, quickly relax, see FIG. 6, to the equilibrium level that corresponds to the temperature of the combustion products. This is due to the fact that the rate of this relaxation of the free radicals to equilibrium increases exponentially with increase in pressure, while on the other hand the equilibrium level of free radicals decreases exponentially with temperature decrease. The higher the level of free radicals available for initiation of combustion the more rapid and stable the combustion process will tend to be. At higher pressures, at which burners in modern gas turbine engines operate in lean partially premixed mode, the relaxation time of the free radicals can be short compared to the "transport" time required for the free radicals (symbolized by arrows 31) to be convected downstream, from the point where they were produced in the shear layer 18 of the main recirculation zone 20, back upstream, towards the flame front 7 and the forward stagnation point P of the main recirculation zone 20. As a consequence, by the time that the reversely circulating flow of radicals 31 within the main recirculation zone 20 have conveyed free radicals 31 back towards the flame front 7, and when they begin to mix with the incoming "fresh" premixed lean fuel and air mixture from the first 10 and second 11 channels at the forward stagnation point P to initiate/sustain combustion process, the free radicals 31 could have reached low equilibrium levels.

This invention utilizes high non-equilibrium levels of free radicals 32 to stabilize the main lean combustion 7. In this invention, the scale of the small pilot combustor 5 is kept small and most of the combustion of fuel occurs in the lean premixed main combustor (at 7 and 18), and not in the small pilot combustor 5. The small pilot combustor 5, can be kept small, because the free radicals 32 are released near the forward stagnation point P of the main recirculation zone 20. This is generally the most efficient location to supply additional heat and free radicals to swirl stabilized combustion (7). As the exit 6 of the small pilot combustor 5 is located at the forward stagnation point P of the main-lean re-circulating flow 20, the time scale between quench and utilization of free radicals 32 is very short not allowing free radicals 32 to relax to low equilibrium levels. The forward stagnation point P of the main-lean re-circulating zone 20 is maintained and aerodynamically stabilized in the quarl (4*a*), at the exit 6 of the small pilot combustor 5. To assure that the distance and time from lean, stoichiometric or rich combustion (zone 22), within the small pilot combustor 5, is as short and direct as possible, the exit of the small pilot combustor 5 is positioned on the centerline and at the small pilot combustor 5 throat 33. On the centerline, at the small pilot combustor 5 throat 33, and within the quarl 4*a*, free radicals 32 are mixed with the products of the lean combustion 31, highly preheated mixture of fuel and air, from duct 30 and space 25*a*, and subsequently with premixed fuel 14 and air 12 in the shear layer 18 of the lean main recirculation zone 20. This is very advantageous for high-pressure gas turbine engines, which inherently exhibit the most severe thermo acoustic instabilities. Also, because the free radicals and heat produced by the small pilot combustor 5 are used efficiently, its size can be small and the quenching process is not required. The possibility to keep the size of the pilot combustor 5, small has also beneficial effect on emissions.

Burner Geometry with Multi Quarl Arrangements

The burner utilizes aerodynamics stabilization of the flame and confines the flame stabilization zone—recirculation zone (20), in the multiple quarl arrangement (4*a*, 4*b* and 4*c*). The multiple quad arrangement is an important feature of the disclosed burner design for the reasons listed below. The quarl (or sometimes called the diffuser):

provides a flame front 7 (the main recirculation zone 20 is anchored without a need to anchore the flame to a solid surface/bluff body and in that way a high thermal loading and issues related to the burner mechanical integrity are avoided, geometry (quarl half angle $\alpha$ and length L) is important to control the size and shape of the recirculation zone 20 in conjunction with the swirl number. The length of the recirculation zone 20 is roughly proportional to 2 to 2.5 of the quarl length L, optimal length is of the order of L/D=1 (D, is quarl throat diameter). The minimum length of the quarl should not be smaller then 0.5 and not longer then 2 (Ref1: The influence of Burner Geometry and Flow Rates on the Stability and Symmetry of Swirl-Stabilized Nonpremixed Flames; V. Milosavljevic et al; Combustion and Flame 80, pages 196-208, 1990), optimal quarl half angle $\alpha$ (Ref1), should not be smaller then 20 and larger then 25 degrees, allows for a lower swirl number before decrease in stability, when compared to less confined flame front, is important to control size and shape of recirculation zone due to expansion as a result of combustion and reduces transport time of free radicals in recirculation zone.

Burner Scaling

The quarl (or diffuser) and the imparted swirl provides a possibility of a simple scaling of the disclosed burner geometry for different burner powers.

To scale burner size down (example):

The channel 11 should be removed and the shell forming quarl 4*c* should thus substitute the shell previously forming quarl 4*b*, which is taken away; the geometry of the quarl 4*c* should be the same as the geometry of the previously existing quarl 4*b*, The Swirl number in channel 10 should stay the same, All other Burner parts should be the same; fuel staging within the burner should stay the same or similar.

To scale burner size up:

Channels 10 and 11 should stay as they are,

Quarl 4*c* should be designed in the same as quarl 4*b* (formed as a thin splitter plate), A new third channel should be arranged outside and surrounding the second channel 11 and a new quarl (not shown in the drawings) outside and surrounding the second channel 11, thus forming an outer wall of the third channel; the shape of the new quarl should be of a shape similar to the shape of former outmost quarl 4*c*.

The Swirl number in the channels should be $S_N$,10>$S_N$, 11>$S_N$,11*b*, but they should all be above $S_N$=0.6 and not higher then 0.8

All other burner parts should be the same

Burner operation and fuel staging within the burner should stay the same or similar.

Fuel Staging and Burner Operation

Figure 4B:
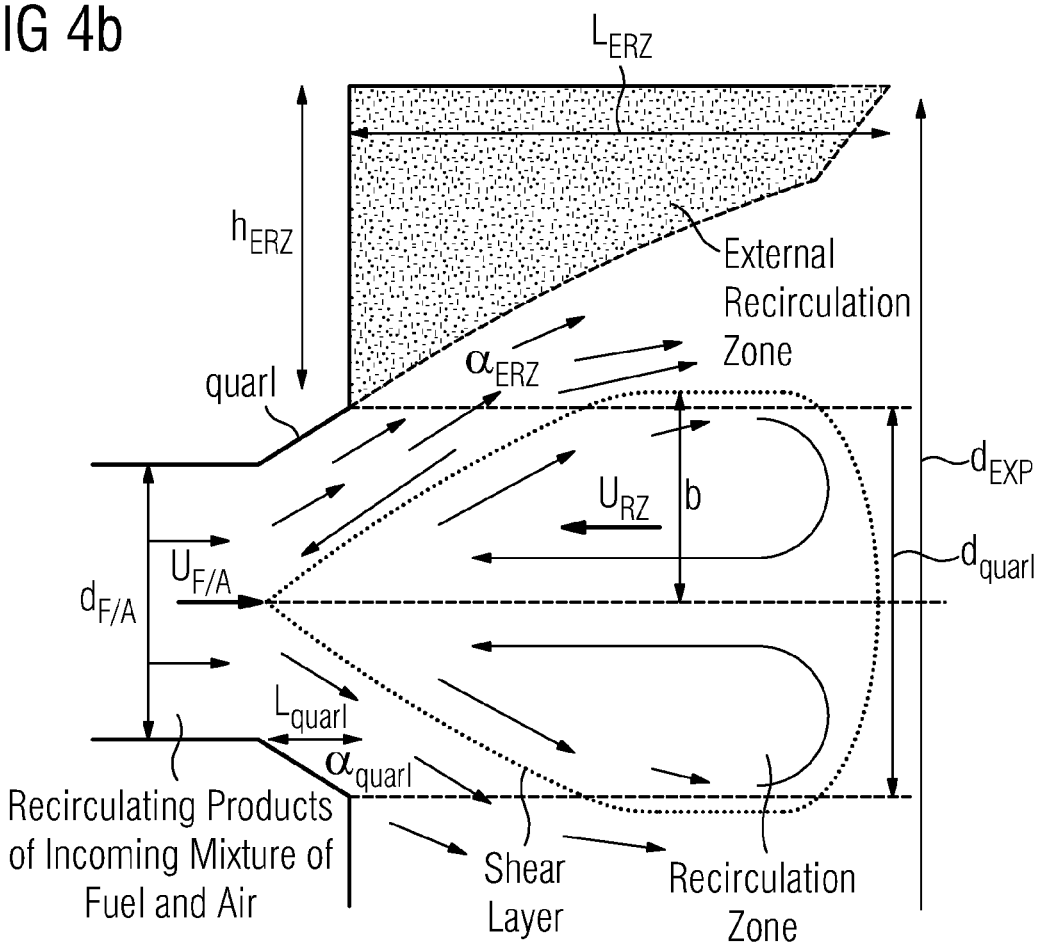
FIG. 4*b*: shows a diagram of combustor near field aerodynamics.
Figure 5:
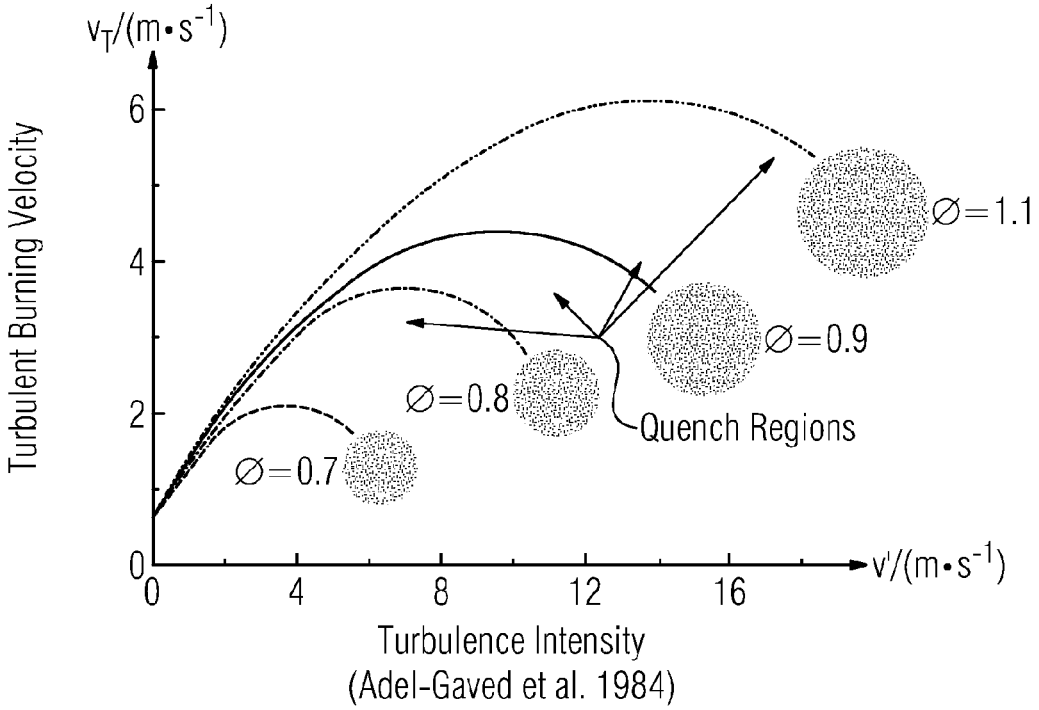
FIG. 5 shows a diagram of turbulence intensity.

When the igniter 34, as in prior art burners, is placed in the outer recirculation zone, which is illustrated in FIG. 4*b*, the fuel/air mixture entering this region must often be made rich in order to make the flame temperature sufficiently hot to sustain stable combustion in this region. The flame then often cannot be propagated to the main recirculation until the main premixed fuel and airflow becomes sufficiently rich, hot and has a sufficient pool of free radicals, which occurs at higher fuel flow rates. When the flame cannot propagate from the outer recirculation zone to the inner main recirculation zone shortly after ignition, it must propagate at higher pressure after the engine speed begins to increase. This transfer of the initiation of the main flame from the outer recirculation zone pilot only after combustor pressure begins to rise results in more rapid relaxation of the free radicals to low equilibrium levels, which is an undesirable characteristic that is counter productive for ignition of the flame at the forward stagnation point of the main recirculation zone. Ignition of the main recirculation may not occur until the pilot sufficiently raises the bulk temperature to a level where the equilibrium levels of free radicals entrained in the main recirculation zone and the production of addition free radicals in the premixed main fuel and air mixture are sufficient to ignite the main recirculation zone. In the process of getting the flame to propagate from the outer to the main recirculation zone, significant amounts of fuel exits the engine without burning from the un-ignited main premixed fuel and air mixture. A problem occurs if the flame transitions to the main recirculation zone in some burner before others in the same engine, because the burners where the flames are stabilized on the inside burn hotter since all of the fuel is burnt. This leads to a burner-to-burner temperature variation which can damage engine components.

The present invention also allows for the ignition of the main combustion 7 to occur at the forward stagnation point P of the main recirculation zone 20. Most gas turbine engines must use an outer recirculation zone, see FIG. 4*b*, as the location where the spark, or torch igniter, ignites the engine. Ignition can only occur if stable combustion can also occur; otherwise the flame will just blow out immediately after ignition. The inner or main recirculation zone 22, as in the present invention, is generally more successful at stabilizing the flame, because the recirculated gas 31 is transported back and the heat from the combustion products of the recirculated gas 31 is focused to a small region at the forward stagnation point P of the main recirculation zone 20. The combustion—flame front 7, also expands outwards in a conical shape from this forward stagnation point P, as illustrated in FIG. 2. This conical expansion downstream allows the heat and free radicals 32 generated upstream to support the combustion downstream allowing the flame front 7 to widen as it moves downstream. The quarl (4*a*, 4*b*, 4*c*), illustrated in FIG. 2, compared to swirl stabilized combustion without the quarl, shows how the quarl shapes the flame to be more conical and less hemispheric in nature. A more conical flame front allows for a point source of heat to initiate combustion of the whole flow field effectively.

In the present invention the combustion process within the burner 1 is staged. In the first stage, the ignition stage, lean flame 35 is initiated in the small pilot combustor 5 by adding fuel 23 mixed with air 24 and igniting the mixture utilizing ignitor 34. After ignition equivalence ratio of the flame 35 in the small pilot combustor 5 is adjusted at either lean (below equivalence ratio 1, and at approximately equivalence ratio of 0.8) or rich conditions (above equivalence ratio 1, and at approximately equivalence ratio between 1.4 and 1.6). The reason why the equivalence ratio within the small pilot combustor 5 is at rich conditions in the range between 1.4 and 1.6 is emission levels. It is possible to operate and maintain the flame 35 in the small combustor pilot 5 at stoichiometric conditions (equivalence ratio of 1), but this option is not recommended because it can result in high emission levels, and higher thermal loading of the walls 21. The benefit of operating and maintaining the flame 35 in the small pilot combustor at either lean or rich conditions is that generated emissions and thermal loading of the walls 21 are low.

In the next stage, a second-low load stage, fuel is added through duct 30 to the cooling air 27 and imparted a swirling motion in swirler 28. In this way combustion of the main lean flame 7, below, at and above LBO limits, is very effectively sustained. The amount of the fuel which can be added to the hot cooling air (preheated at temperatures well above 750 C), can correspond to equivalence ratios>3.

In the next stage of the burner operation, a third part and full load stage fuel 14 is gradually added to the air 12, which is the main air flow to the main flame 7.

The invention claimed is:

1. A burner for a gas turbine engine, comprising:

a burner housing in which the burner is enclosed, the burner having axially opposed upstream and downstream end portions;

a pilot combustor disposed at the upstream end of the burner;

a plurality of quarl sections surrounding an exit of the pilot combustor and extend from the exit in a downstream direction;

a main combustion room is defined downstream from the pilot combustor by end portions of the plurality of quarls; and a first channel defined as a substantially annular space between an upstream quarl section, first quarl section, and the closest downstream quarl section, second quarl section, providing air and fuel to a main flame in the main combustion room, wherein the pilot combustor is provided with fuel and air for burning the fuel and is sized to effect creation of a first flow of an unquenched concentration of radicals at non-equilibrium and heat from a pilot combustion zone directed downstream along a centre line of the pilot combustor through a throat at the exit of the pilot combustor, wherein less fuel is supplied to the pilot combustor than to the main combustion room, wherein an outer quarl section, second quarl section, includes a greater first diameter than an second diameter of an inner quarl section, first quarl section, wherein the outer quarl section, second quarl section, extends a greater distance downstream than the inner quarl, first quarl section, and wherein the main combustion room is arranged to house the main flame and a recirculation zone for directing a second flow of free radicals back to a forward stagnation point at the exit of the pilot combustor.

2. The burner as claimed in claim 1, wherein a first swirler is arranged at a first inlet of the first channel for generating a swirl of fuel and air in the first channel.

3. The burner as claimed in claim 2, wherein a second channel is defined as a substantially annular space between the second quarl section and a third quarl section.

4. The burner as claimed in claim 3, wherein the first swirler is arranged across both the first inlet of the first channel and a second inlet of the second channel, and wherein the first swirler generates a swirl of fuel and air in the first and second channels.

5. The burner as claimed in claim 3, wherein a third annular channel for providing premixed air and fuel to the main flame is the second channel and is located downstream of the first channel.

6. The burner as claimed in claim 5, wherein the pilot combustor is substantially surrounded by a perforated plate, wherein cooling air is provided through a cooling air inlet for penetrating the perforated plate and for cooling a plurality of side walls of the pilot combustor, wherein the cooling air is let through a second swirler arranged around a fourth quarl of the pilot combustor, wherein fuel is added through a fuel duct and directed through the second swirler, and wherein the cooling air and the added fuel is premixed in the second swirler and provided to the main flame at the exit of the pilot combustor.

7. The burner as claimed in claim 2, wherein an imparted level of swirl is arranged such that a swirl number is above 0.6 and not higher than 0.8.

8. The burner as claimed in claim 1, wherein a quarl half angle is above 20 degrees and below 25 degrees.

9. The burner as claimed in claim 8, wherein a length/diameter of the quarl is greater than 0.5, and wherein the length/diameter of the quarl is less than 2.

10. The burner as claimed in claim 9, wherein the length/diameter of the quarl equals 1.

11. The burner as claimed in claim 1, wherein premixed air and fuel is added to the main flame from a plurality of annular channels distributed along the downstream direction of the main flame.

12. The burner as claimed in claim 11, wherein a first annular channel of the plurality of annular channels for the provision of premixed air and fuel to the main flame is arranged around the exit of the pilot combustor at an upstream end of the main flame, and wherein a second annular channel is the first channel and is located further downstream.

13. The burner as claimed in claim 1, wherein the pilot combustor is substantially surrounded by a perforated plate, wherein cooling air is provided through a cooling air inlet for penetrating the perforated plate and for cooling a plurality of side walls of the pilot combustor, wherein the cooling air is in a heated state supplied to the main flame, and wherein the heated cooling air is released around a fourth quarl of the pilot combustor thereby supplying the heated cooling air to the main flame at the most upstream end of the main flame.

14. The burner as claimed in claim 1, wherein the pilot combustor is substantially surrounded by a perforated plate, wherein cooling air is provided through a cooling air inlet for penetrating the perforated plate and for cooling a plurality of side walls of the pilot combustor, wherein the cooling air is in a heated state supplied to the main flame, and wherein the heated cooling air is let out into the first channel thereby introduced to the main flame from the first channel running through one of the first quarl, the second quarl, or a third quarl defining a combustion room housing a combustion process.

15. The burner as claimed in claim 1, wherein the pilot combustor is substantially surrounded by a perforated plate, wherein cooling air is provided through a cooling air inlet for penetrating the perforated plate and for cooling a plurality of side walls of the pilot combustor, wherein the cooling air is in a heated state supplied to the main flame, and wherein the cooling air is provided to a main lean partially premixed combustion process whereby the cooling air is a mixture of:

the heated cooling air that is released around the fourth quarl of the pilot combustor thereby supplying the heated cooling air to the main flame at the most upstream end of the main flame; and the heated cooling air that is let out into the first channel thereby introduced to the main flame from the first channel running through one of the first quarl, the second quarl, or a third quarl defining a combustion room housing a combustion process.

16. The burner as claimed in claim 1, wherein the pilot combustor includes a fuel inlet for fuel and an air inlet for air, and wherein the fuel and the air is ignited with an igniter for creating a pilot combustor flame.

17. The burner as claimed in claim 1, wherein the pilot combustor has a surface area that is sized to provide flame quenching in the pilot combustor.

18. The burner as claimed in claim 1, wherein the pilot combustor is configured to burn up to 1% of a total fuel flow.

19. The burner as claimed in claim 1, wherein the main combustion room is configured to burn more than 90% of a total fuel flow.

* * * * *